US008694147B2

(12) United States Patent
Okuyama

(10) Patent No.: US 8,694,147 B2
(45) Date of Patent: Apr. 8, 2014

(54) EMBROIDERY DATA GENERATING DEVICE, COMPUTER-READABLE STORAGE MEDIUM STORING EMBROIDERY DATA PROCESSING PROGRAM AND SEWING MACHINE

(75) Inventor: Tsuneo Okuyama, Inabe-gun (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 44 days.

(21) Appl. No.: 13/614,352

(22) Filed: Sep. 13, 2012

(65) Prior Publication Data

US 2013/0079916 A1 Mar. 28, 2013

(30) Foreign Application Priority Data

Sep. 27, 2011 (JP) ..... 2011-210759

(51) Int. Cl.
*D05C 5/02* (2006.01)

(52) U.S. Cl.
USPC ..... 700/138; 112/470.01

(58) Field of Classification Search
USPC ..... 700/136–138; 112/470.01, 470.04, 112/470.06, 475.18, 475.19
See application file for complete search history.

(56) References Cited

U.S. PATENT DOCUMENTS

| | | | | | |
|---|---|---|---|---|---|
| 4,869,188 | A | * | 9/1989 | Hyodo | 112/470.04 |
| 5,740,057 | A | * | 4/1998 | Futamura | 700/138 |
| 5,954,004 | A | * | 9/1999 | Futamura | 112/475.19 |
| 6,304,793 | B1 | | 10/2001 | Komiya et al. | |
| 6,321,670 | B1 | * | 11/2001 | Tomita et al. | 112/475.19 |
| RE38,718 | E | * | 3/2005 | Futamura | 700/138 |
| 6,980,877 | B1 | * | 12/2005 | Hagino et al. | 700/138 |
| 2012/0197430 | A1 | | 8/2012 | Maki et al. | |

FOREIGN PATENT DOCUMENTS

| | | |
|---|---|---|
| JP | A-11-057262 | 3/1999 |
| JP | A-2012-157451 | 8/2012 |

* cited by examiner

*Primary Examiner* — Nathan Durham
(74) *Attorney, Agent, or Firm* — Oliff PLC

(57) ABSTRACT

An embroidery data generating device includes an embroidery data storage unit storing data of a plurality of embroidery data, an embroidery data selection unit selecting a desired one of the embroidery data stored on the embroidery data storage unit, a color data storage unit storing data of a plurality of defined colors, and an assignment unit randomly extracting colors from the color data storage unit, the extracted colors being used as thread color data for specifying colors of the color-based pattern portions respectively, the assignment unit assigning the extracted colors to the respective color-based pattern portions composing the selected embroidery pattern. When the embroidery data selected by the embroidery data selection unit includes thread color data of two or more color-based pattern portions having a same color, a randomly extracted color is assigned to the color-based pattern portions so that the color-based pattern portions have the same color.

9 Claims, 13 Drawing Sheets

| EMBROIDERY DATA | |
|---|---|
| FIRST PATTERN PORTION DATA | PATTERN 1 RED |
| | Xa0,Ya0 |
| | Xa1,Ya1 |
| | Xa2,Ya2 |
| | ⋮ |
| | XaN,YaN |
| SECOND PATTERN PORTION DATA | PATTERN 2 WHITE |
| | Xb0,Yb0 |
| | Xb1,Yb1 |
| | Xb2,Yb2 |
| | ⋮ |
| | XbN,YbN |
| THIRD PATTERN PORTION DATA | PATTERN 3 BLUE |
| | Xc0,Yc0 |
| | Xc1,Yc1 |
| | Xc2,Yc2 |
| | ⋮ |
| | XcN,YcN |
| ⋮ | ⋮ |
| *n*-TH PATTERN PORTION DATA | PATTERN n BLUE |
| | Xn0,Yn0 |
| | Xn1,Yn1 |
| | Xn2,Yn2 |
| | ⋮ |
| | XnN,YnN |

FIG. 3

| NEEDLE BAR NO. | THREAD COLOR |
|---|---|
| 1 | PURPLE |
| 2 | BLACK |
| 3 | ORANGE |
| 4 | BROWN |
| 5 | PINK |
| ⋮ | ⋮ |
| 10 | |

FIG.5

| THREAD COLOR DATA |
|---|
| RED |
| WHITE |
| BLUE |
| GREEN |
| RED |
| WHITE |
| BLUE |
| GREEN |
| YELLOW |
| RED |
| WHITE |
| BLUE |

FIG.10A

| THREAD COLOR DATA |
|---|
| PURPLE |
| BLACK |
| ORANGE |
| BROWN |
| PURPLE |
| BLACK |
| ORANGE |
| BROWN |
| PINK |
| PURPLE |
| BLACK |
| ORANGE |

FIG.10B

| ORIGINAL THREAD COLOR DATA | USE NUMBER k | EXTRACTED THREAD COLOR DATA |
|---|---|---|
| RED | 3 | PURPLE |
| WHITE | 3 | BLACK |
| BLUE | 3 | ORANGE |
| GREEN | 2 | BROWN |
| YELLOW | 1 | PINK |

FIG.11

EMBROIDERY DATA GENERATING DEVICE, COMPUTER-READABLE STORAGE MEDIUM STORING EMBROIDERY DATA PROCESSING PROGRAM AND SEWING MACHINE

CROSS-REFERENCE TO RELATED APPLICATIONS

This application is based upon and claims the benefit of priority from the prior Japanese Patent Application No. 2011-210759 filed on Sep. 27, 2011, the entire contents of which are incorporated herein by reference.

BACKGROUND

1. Technical Field

The present disclosure relates to an embroidery data generating device which generates embroidery data of an embroidery pattern composed of a plurality of color-based pattern portions, a computer-readable storage medium which stores an embroidery data processing program, and a sewing machine.

2. Related Art

There have conventionally been known multi-needle sewing machines which sew an embroidery pattern based on embroidery data. One of the multi-needle sewing machines is provided with a plurality of needle bars to which needles are attached respectively. Different colors of needle threads are supplied to the respective needles of the needle bars. Data of a plurality of embroidery patterns is stored on a storage device built in the multi-needle sewing machine or on an external storage device such as a ROM card or a flexible disc. When a user selects a desirable one of the plural embroidery patterns, the multi-needle sewing machine reads embroidery data of the selected embroidery pattern to sew the embroidery pattern on a workpiece cloth while transferring an embroidery frame holding the cloth by a transfer mechanism.

An embroidery pattern normally includes a plurality of color-based pattern portions. More specifically, embroidery data of an embroidery pattern includes thread color data for identifying colors of the color-based pattern portions. One of the needle bars is selected and the selected needle bar is moved to a sewing position so that each color-based pattern portion is sewn in a set color (thread color). In this case, when the color of each color-based pattern portion is similar to a color of the workpiece cloth (fabric) on which the embroidery pattern is to be sewn, there would occur a problem that each color-based pattern portion is difficult to distinguish from the workpiece cloth. For example, when an embroidery pattern of "flower" is sewn on a workpiece cloth that has the same color as a color of the color-based pattern portion of a flower petal, the flower petal and the workpiece cloth are difficult to distinguish each from the other, whereupon there is a possibility that the embroidery pattern may mistakenly be regarded as an odd flower without flower petal.

In view of the above-described drawback, the conventional art provides an embroidery data generating device which stores coloration data indicative of preferable combinations of colors, so that colors of thread color data of color-based pattern portions are set on the basis of cloth data indicative of the coloration data, color of the workpiece cloth and the like.

The aforementioned conventional embroidery data generating device unmistakably determines colors of color-based pattern portions of an embroidery pattern based on the color of the workpiece cloth and coloration data. However, the user would sometimes like to sew each color-based pattern portion in a preferable color or an odd color but not using a previously set color. Furthermore, in order that such designation of colors of an embroidery pattern may be carried out, data of each color-based pattern portion needs to be read one by one for the user to confirm and designate thread color data, with the result that the embroidery sewing is troublesome.

Furthermore, in the case where the number of types of thread color data for color-based pattern portions or the number of types of colors is large when sewing is carried out by the multi-needle sewing machine on the basis of the embroidery data, the increase in the number of colors necessitates frequent replacement of thread spools, resulting in adverse effects on the sewing work.

SUMMARY

Therefore, an object of the disclosure is to provide an embroidery data generating device which can easily carry out coloration of the embroidery pattern and can obtain a variety of suitable coloration patterns using original embroidery data, and a computer-readable storage medium storing an embroidery data processing program and a sewing machine suitable for use with the embroidery data generating device.

The disclosure provides an embroidery data generating device which generates embroidery data usable to sew, by a sewing machine, an embroidery pattern composed of a plurality of color-based pattern portions. The device comprises an embroidery data storage unit which is configured to store a plurality of embroidery data; an embroidery data selection unit which is configured to select a desired one of the embroidery data stored on the embroidery data storage unit; a color data storage unit which is configured to store data of a plurality of defined colors; and an assignment unit which is configured to randomly extract colors from the colors stored on the color data storage unit, the extracted colors being used as thread color data for specifying colors of the color-based pattern portions respectively, the assignment unit assigning the extracted colors to the respective color-based pattern portions composing the selected embroidery pattern. When the embroidery data selected by the embroidery data selection unit includes thread color data of two or more color-based pattern portions having a same color, a randomly extracted color is assigned to said two or more color-based pattern portions so that said two or more color-based pattern portions have the same color and the thread color is updated.

BRIEF DESCRIPTION OF THE DRAWINGS

In the accompanying drawings:

FIG. 3 exemplifies embroidery data;

FIG. 5 exemplifies a needle-bar thread color table;

FIGS. 10A and 10B show original colors of the color-based pattern portions stored in the storage area and changed colors respectively;

FIG. 11 exemplifies a changed color table;

DETAILED DESCRIPTION

Figure 1:
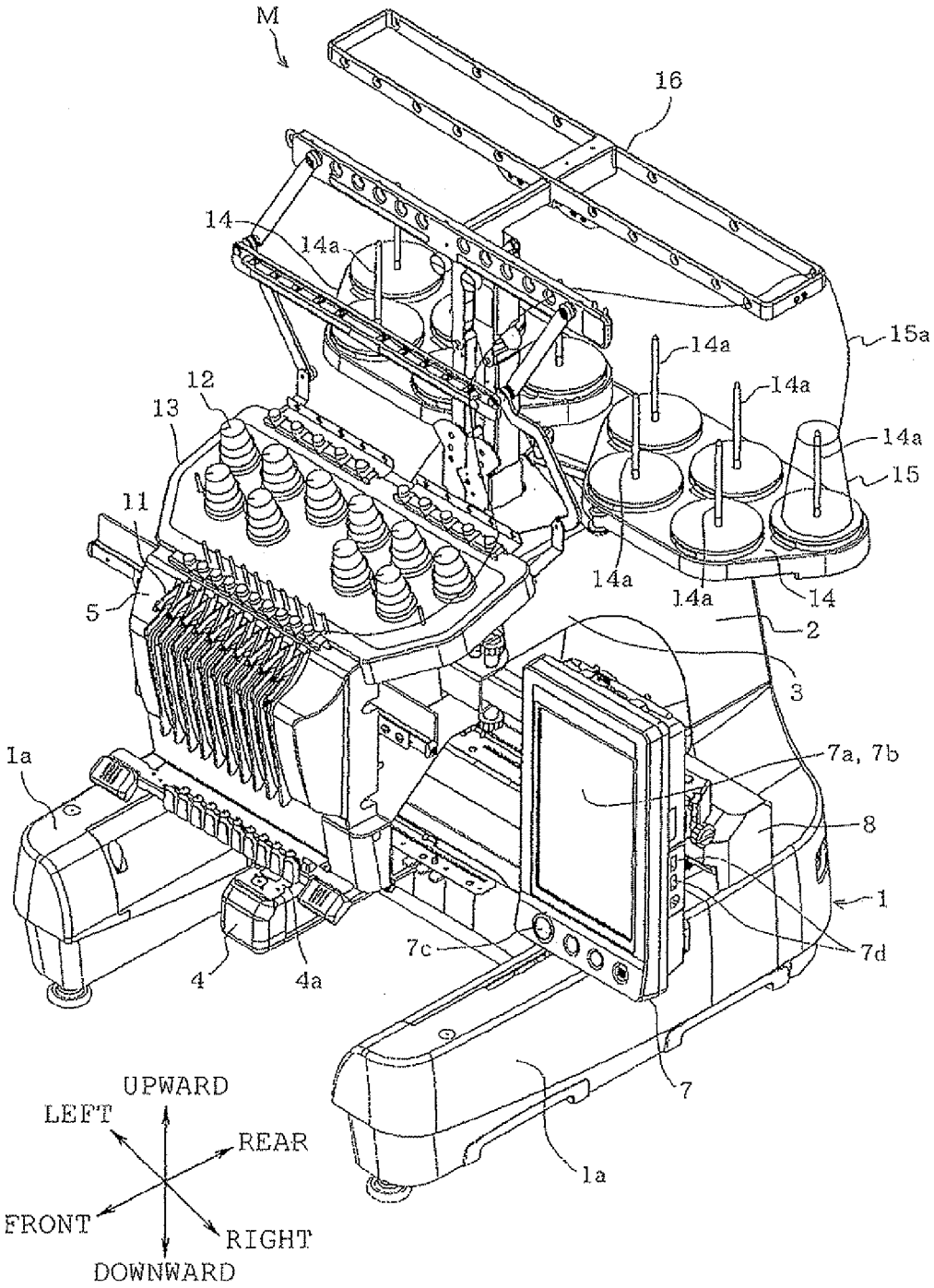
FIG. 1 is an overall perspective view of the multi-needle sewing machine in accordance with a first example.

A first example of multi-needle sewing machine (hereinafter, "sewing machine M") will be described with reference to FIGS. 1 to 14. Referring to FIG. 1, the side where the user is located relative to the sewing machine M will be referred to as "front" and the side opposed to the front will be referred to as "rear." A right obliquely downward direction on FIG. 1 will be referred to as "right" and the direction opposite the right will be referred to as "left" with respect to the sewing machine M. A vertically upward direction on FIG. 1 will be referred to as "upward" and the direction opposite the upward direction will be referred to as "downward" with respect to the sewing machine M.

The sewing machine M includes a support leg 1 supporting the entire sewing machine, a pillar 2 standing from a rear end of the support leg 1, an arm 3 extending frontward from an upper part of the pillar 2 and a needle-bar case 5 attached to a front end of the arm 3, as shown in FIG. 1. The sewing machine M further includes a control device 6 (see FIG. 2) and an operation panel 7. The support leg 1 has right and left leg portions la extending frontward and is formed into a generally U-shape with an open front as viewed from above. A cylinder bed 4 extending frontward is mounted on a central rear of the support leg 1. The cylinder bed 4 has an upper surface to which a needle plate 4*a* is mounted. The needle plate 4*a* has a needle hole (not shown) serving as a needle location of a needle 11 as will be described later.

A carriage 8 is disposed on the upper side of the support leg 1 so as to extend in the right-left direction. The carriage 8 houses an X-direction drive mechanism 9*x* (see FIG. 2) which drives a frame mount (not shown) located at the front side of the carriage 8, in the right-left or X direction. The leg portions is house a Y-direction drive mechanism 9*y* (see FIG. 2) which drives the carriage 8 in the front-rear or Y direction. An X-axis motor 30 and a Y-axis motor 31 serve as drive sources for the X-direction and Y-direction drive mechanisms 9*x* and 9*y* respectively. A workpiece cloth on which an embroidery pattern is to be sewn is held on a generally rectangular embroidery frame although neither shown. Thus, the embroidery frame is moved together with the carriage 8 in the X direction or together with the frame mount by the X-direction and Y-direction drive mechanisms 9*x* and 9*y*, whereby the workpiece cloth is fed for sewing purposes. The workpiece cloth is moved with movement of the embroidery frame in the X and Y directions.

Ten needle bars 10 (as shown in only FIG. 2) are supported in the needle-bar case 5 so as to be arranged in a right-left direction and so as to vertically extend. The needle bars 10 are movable upward and downward and have lower ends to which sewing needles (not shown) are attached respectively. The needle bars 10 are assigned with needle bar numbers 1 to 10 sequentially from the right one as viewed at the front of the sewing machine M. Ten thread take-up levers 11 corresponding to the respective needle bars 10 are mounted on the needle-bar case 5 so as to be movable up and down. A thread tension bracket 13 is fixed in an inclined state to an upper end of the needle bar case 5. Ten thread tension completes 12 are mounted on the thread tension bracket 13 for adjustment of thread tensions. A pair of right and left spool holder bases 14 and a thread guide mechanism 16 are provided in the rear of the thread tension bracket 13 so as to be located above the rear side of the arm 3. The thread guide mechanism 16 is configured to prevent the thread from being entangled.

Further referring to FIG. 1, each spool holder base 14 is formed into a substantially trapezoidal shape as viewed on a planar view. Each spool holder base 14 has five spool pins 14*a* to which thread spools 15 are to be fitted respectively. More specifically, ten thread spools 15 the number of which is the same as that of the needles can be set on the paired spool holder bases 14. Only one of the thread spools 15 is shown in FIG. 1 for the sake of ease of explanation. Needle threads 15*a* drawn from the respective thread spools 15 are supplied through the aforementioned thread guide mechanism 16, thread tension completes 12, thread take-up levers 11 and the like to be inserted through respective needle eyes (not shown) of the sewing needles.

A needle bar selecting mechanism 20 (see FIG. 2) is disposed in the arm 3 for moving the needle-bar case 5 in the X direction. The needle bar selecting mechanism 20 is driven by a drive motor (not shown) to selectively switch one of ten groups of the needle bars 10 and the thread take-up levers 11 to a sewing location. The switched needle bar 10 and thread take-up lever 11 are vertically moved at the sewing location in a synchronous manner by a needle-bar drive mechanism 22 (see FIG. 2). The needle-bar drive mechanism 22 is driven by transmitting rotation of a sewing machine motor 21 (see FIG. 2) housed in the pillar 2 via a main shaft (not shown) thereto. Furthermore, on the front end of the cylinder bed 4 are mounted a rotary hook (not shown) accommodating a bobbin on which a bobbin thread (not shown) is wound and a cutting mechanism 19 (see FIG. 2) which cuts the needle thread 15*a* and the bobbin thread.

Stitches consisting of the needle thread 15*a* and bobbin thread are formed on the workpiece cloth held by the embroidery frame by cooperation among the needle bar 10, the thread take-up lever 11 and the rotary hook. In this case, the embroidery frame is transferred in the X and Y directions on the basis of embroidery data which will be described later, whereby an embroidery pattern is sewn on the workpiece cloth.

An operation panel 7 is mounted on a right side of the arm 3 so as to be foldable. The operation panel 7 includes an oblong liquid crystal color display 7*a* (hereinafter, "display 7*a*") which can perform full-color display, for example. The display 7*a* displays various embroidery patterns and function names which cause the sewing machine to execute various functions necessary for the sewing operation. The display 7*a* further displays information about the needle thread 15*a* which is set so as to correspond to the needle bar 10, a setting screen on which colors of embroidery patterns are set as will be described later, and the like (see FIG. 6). A touch panel 7*b* (see FIG. 2) is mounted on a front of the display 7*a* and has a plurality of touch keys each including a transparent electrode. When the touch keys are depressed by user's finger or a touch pen (not shown), the sewing machine can execute selection of an embroidery pattern, setting of various parameters, instruction of functions, setting at the time of replacement of thread spools 15 as will be described later, and the like.

The operation panel 7 has a plurality of switches which is located on a lower front thereof and includes a start/stop switch 7*c*. The operation panel 7 includes a connector 7*d* which is mounted in one side thereof and to which an external storage medium such as a USB memory (not shown) is connectable.

Figure 2:
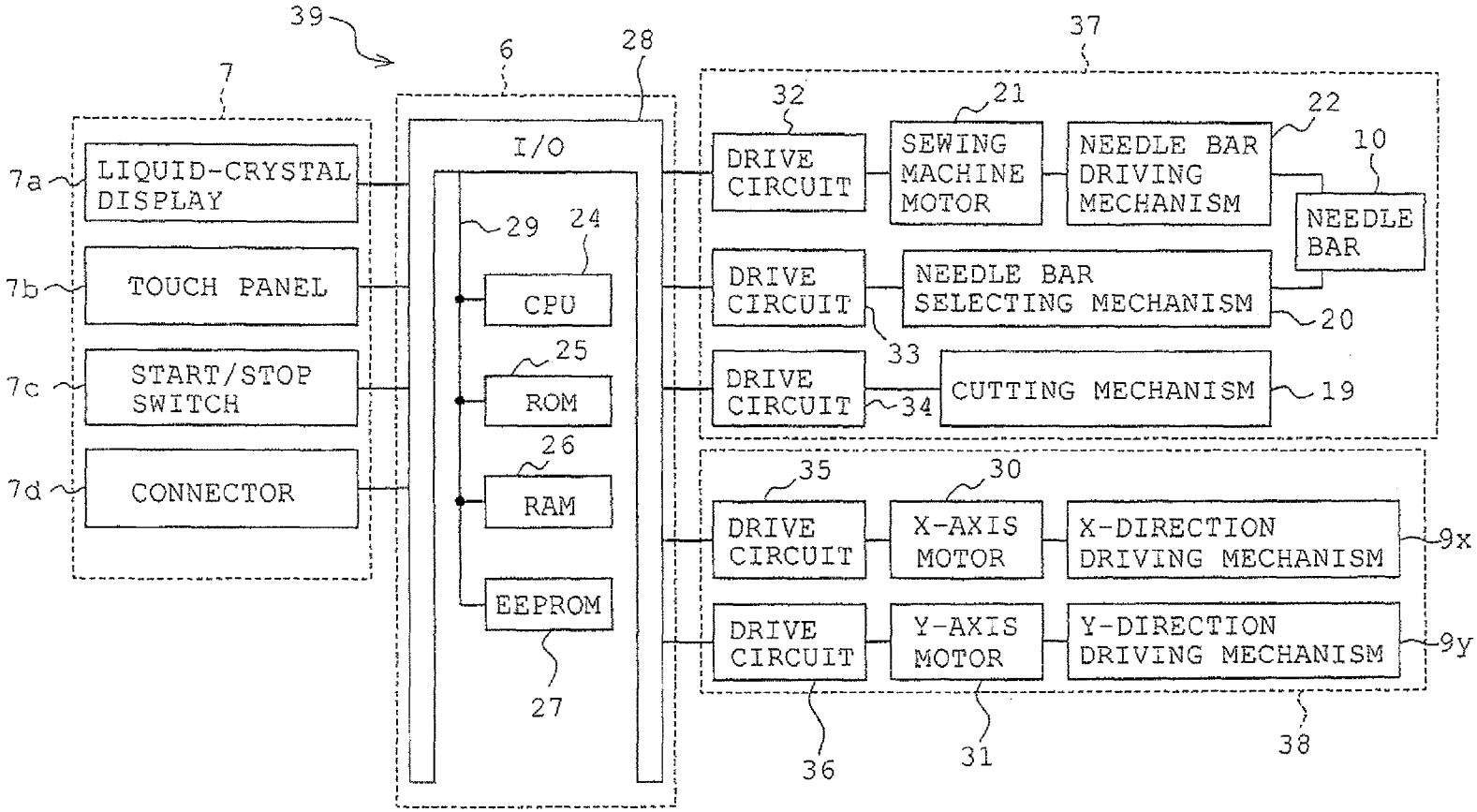
FIG. 2 is a block diagram showing an electrical arrangement of the machine.
Figure 4:
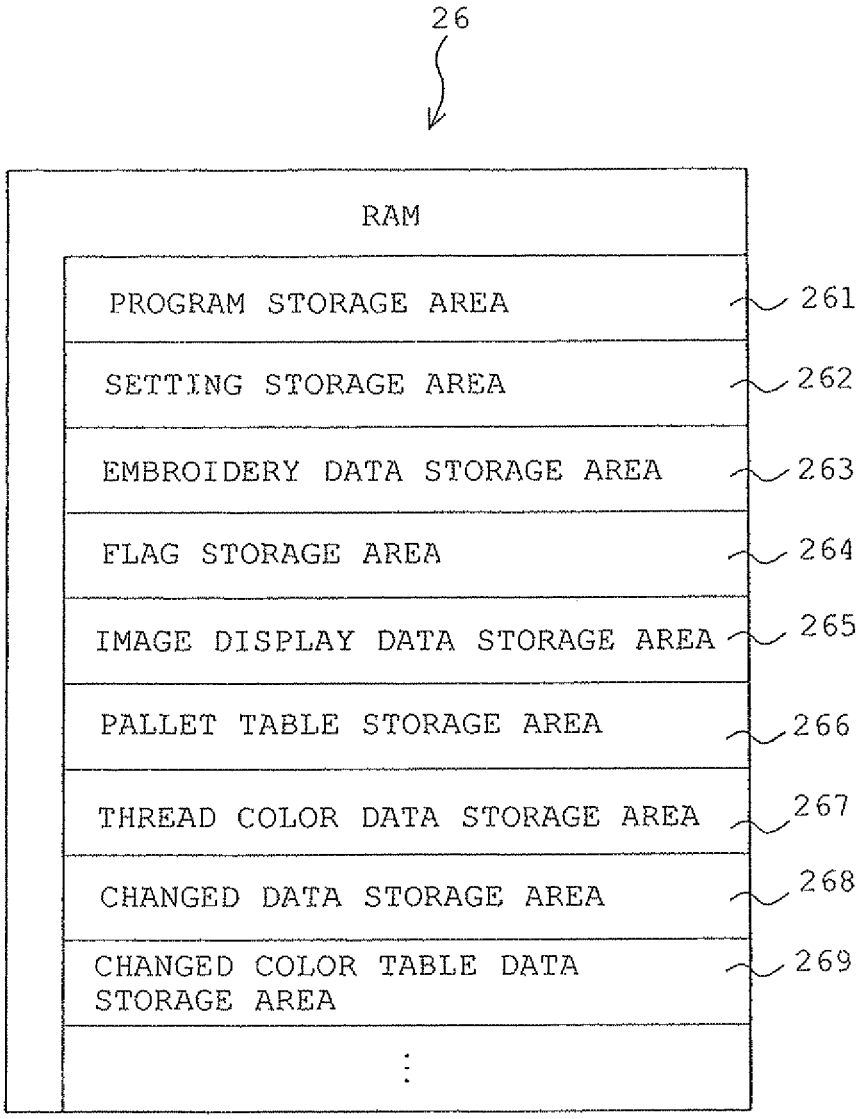
FIG. 4 shows storage areas of a RAM of the machine.

An electrical arrangement of the control system of the sewing machine M will now be described with reference to the block diagram of FIG. 2. The control device 6 is mainly configured by a microcomputer and incorporates a CPU 24, a ROM 25, a RAM 26, an EEPROM 27, an input/output (I/O) interface 28, buses 29 connecting these devices 24-27 to the I/O interface 28, and the like. To the I/O interface 28 are connected the display 7*a*, the touch panel 7*b*, the start/stop switch 7*c* and the connector 7*d*. To the I/O interface 28 are also connected drive circuits 32 to 36 driving the sewing machine motor 21, the needle bar selecting mechanism 20, the cutting mechanism 19, the X-axis motor 30 and the Y-axis motor 31 respectively.

In the sewing machine a sewing unit 37 is constituted by the needle bars 10, the needle, the rotary hook, the sewing machine motor 21, the needle-bar drive mechanism 22, the needle-bar selecting mechanism 20, the cutting mechanism 19, the drive circuits 32 to 34 and the like. A transfer unit 38 which transfers the embroidery frame holding the workpiece cloth is constituted by the Y-direction drive mechanism 9*y* transferring the embroidery frame holding the workpiece cloth, the X-direction drive mechanism 9*x*, the X-axis motor 30, the Y-axis motor 31, the drive circuits 35 and 36 and the like. The control device 6 controls the above-described actuators in accordance with a sewing control program, embroidery data and the like as will be described later, thereby executing a sequence of sewing operation for the workpiece cloth by cooperation between the sewing unit 37 and the transfer unit 38.

Furthermore, in the sewing machine M, the control device 6, the display 7*a*, the touch panel 7*b* and the like constitute an embroidery data generating device 39. The control device 6 and the display 7*a* constitute a display unit.

The ROM 25 serving as an embroidery data storage unit stores embroidery data, a sewing control program and a full thread information table about a plurality of types of threads used for embroidery sewing, inclusive of information about thread color, part number and the like. The ROM 25 also stores an embroidery data processing program which will be described later, a thread designation control program which is run in order that the user may correlate thread color data of the needle thread 15*a* supplied from the thread spool 15 to the needle bar 10, and a display control program which is run in order that the display 7*a* of the operation panel 7 may be controlled. These programs and data may be stored by another inner storage unit such as EEPROM 27 or the like or by an external storage unit such as the USB memory.

Figure 9:
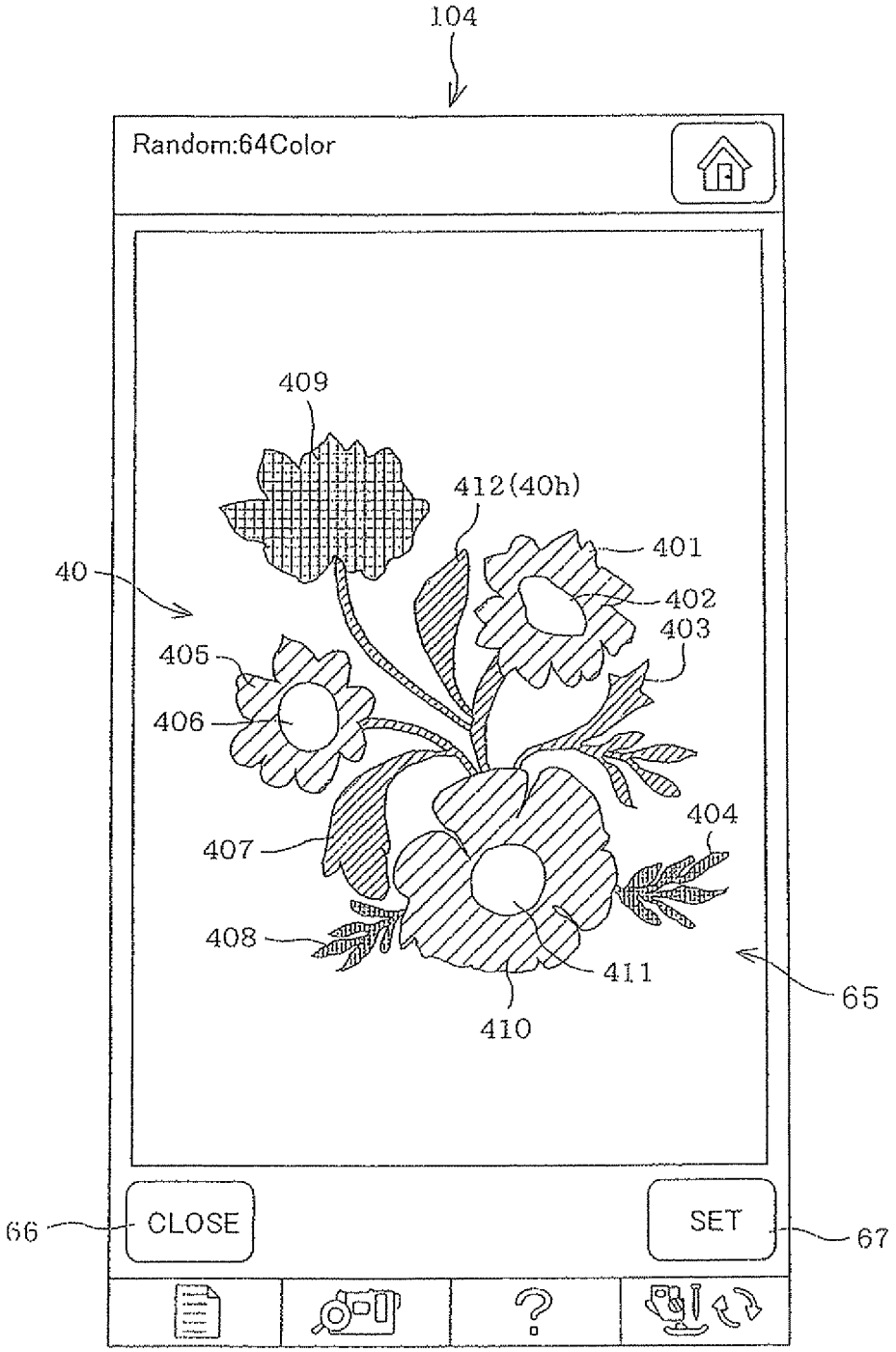
FIG. 9 exemplifies an enlarged display screen.

An embroidery pattern 40 of "flower" displayed on a screen 104 of the display 7*a* as shown in FIG. 9 will be described as an example of the embroidery pattern. The embroidery pattern 40 includes a first pattern portion 401 to a twelfth pattern portion 412 (an n-th pattern portion 40*n*) serving as a plurality of (n-number of) color-based pattern portions. More specifically, for example, first, fifth and tenth pattern portions 401, 405 and 410 all composing respective flower petals are sewn using a red thread. Second, sixth and eleventh pattern portions 402, 406 and 411 all composing central parts of the respective flower petals are sewn using a white thread. A ninth pattern portion 409 composing the other flower is sewn using a yellow thread. Furthermore, third, seventh and twelfth pattern portions 403, 407 and 412 all composing respective leaves and stalks are sewn using a blue thread. Fourth and eighth pattern portions 404 and 908 both composing respective lower leaves in the embroidery pattern 40 are sewn using a green thread.

Embroidery data is used to sew an embroidery pattern by the sewing machine M and includes data of a plurality of color-based pattern portions. For example, the embroidery data of embroidery pattern 40 includes data of a plurality of needle locations set for every one of color-based pattern portions 401 to 412, data of sewing sequence for specifying a sewing sequence of color-based pattern portions 401 to 412 (pattern 1 to pattern n), and thread color data, as shown in FIG. 3. The thread color data is used to specify colors of the above-described color-based pattern portions, and colors selected from the color information are assigned to the color-based pattern portions, respectively.

Sewing sequence data "pattern 1" on the top of FIG. 3 specifies an initial sewing, and "red" corresponding to "pattern 1" is actually thread color data shown by RGB values, for example. Furthermore, needle location data "XaO, YaO" . . . "XaN, YaN" indicates coordinates of needle locations of a needle corresponding to the thread color of "red". In the same manner, embroidery data for second and subsequent sewing also include sewing sequence data "pattern 2" to "pattern n," thread color data "white" to "blue" and needle location data "XbN, YbN to XnN, YnN." The embroidery data also includes image data (image in a BMP format, for example; and not shown) to be displayed on the display 7*a*, and an image of embroidery pattern is displayed on the display 7*a* in colors assigned to respective thread color data.

The RAM 26 has memory areas which temporarily store the abovementioned programs and data, various settings input on the touch panel 7*b*, results of operation carried out by the control device 6, etc. More specifically, as shown in FIG. 3, the RAM 26 has a plurality of storage areas including a program storage area 261, a setting storage area 262, an embroidery data storage area 263, a flag storage area 264, an image display data storage area 265, a pallet table storage area 266, a thread color data storage area 267, a changed data storage area 268 and a changed color table storage area 269. The program storage area 261 stores various programs read from the ROM 25 and the like. The setting storage area 262 stores set values, tables and the like which are referred to in execution of programs. The embroidery data storage area 263 stores original (reference) data in setting the color of the embroidery data. The flag storage area 264 stores various flags used in execution of programs. The image display data storage area 265 stores image data of screens to be displayed on the display 7*a* and display settings.

The pallet table storage area 266 stores data used for coloration of an embroidery pattern, thus storing a pallet table and the like. Furthermore, the changed color table storage area 269 stores a changed color table in which a color extracted from the pallet table or the like in a random manner and the use of the original color before extraction are correlated with each other (see FIG. 11). The thread color data storage area 267 stores data of an original color of each color-based pattern portion before extraction (see FIG. 10A). The changed data storage area 268 stores data of a color of each color-based pattern portion after extraction (see FIG. 10B). For example, in the embroidery pattern 40, the color-based pattern portions 401 to 412 have respective original colors of red, white, blue, green, . . . and blue from the head of the thread color data storage area 267 in the sewing sequence, whereby the original colors are grasped as corresponding to the respective color-based pattern portions 401 to 412 respectively.

The EEPROM 27 stores a needle bar thread color table in which the thread colors of thread spools 15 are correlated with the needle bars 10 respectively, as shown in FIG. 5. When change of thread spools 15 is necessary in the sewing, the display 7*a* displays a thread spool setting screen (not shown) on which thread colors are assigned to the respective needle bars 10 based on the thread color data of the embroidery data. For example, assume now that five displayed thread colors are assigned to the needle bars 10 in the sequence of needle bar numbers as shown in FIG. 5. In this case, the user refers to the thread colors to set the thread spools 15 of "purple" to "pink" corresponding to needle bar numbers 1 to 5 respectively, thereby carrying out thread guard of the needle thread 15*a*. The EEPROM 27 stores, as thread spool color data, thread colors of the needle threads 15*a*, that is, the thread colors of the thread spools 15 set on the spool holder bases 14, corresponding to needle bar numbers respectively.

The thread spool color data is data of colors of the thread spools 15 and is defined by RGB values. Since the EEPROM 27 stores thread color data of the embroidery data which have been selected by the user and have been caused to correspond to the needle bar numbers respectively, an input operation by the user is not necessary. The user can set the thread spool color data of the EEPROM 27 for every needle bar number on the basis of operation of the touch panel 7*b* according to user's preference, while viewing the display 7*a*.

The EEPROM 27 stores information (color information) about a plurality of colors to be assigned as thread color data and serves as a color data storage unit together with the RAM 26. The color information relates to thread colors of the thread spools 15 usable with the sewing machine M and is defined by RGB values. More specifically, the EEPROM 27 stores a first pallet table (see a first color pallet 53 in FIG. 6) including RGB values of 64 colors and pallet color numbers 1 to 64 corresponding to the respective RGB values. The EEPROM 27 further stores, as a second pallet table (not shown), a plurality of colors selected from the color information data by the user aside from 64-color pallet table. The second pallet table is a custom pallet table in which color numbers 1 to 300 by pallets corresponding to respective RGB values are settable according to user's preference.

Furthermore, HSV values are also used in this example in addition to the RGB values. The HSV values are defined by hue, saturation and value in an HSV space, corresponding to the respective RGB values. The HSV values are computed on the basis of RGB values by a known obtaining method by the control device 6 and represented by values of hue H, color saturation S and value V. In this case, the hue represents a type of color such as red, purple, blue, etc. and has a value ranging from 0 to 360, for example. The saturation represents a color vividness and has a value ranging from 0.0 to 1.0, for example. The value represents color brightness and has a value ranging from 0.0 to 1.0.

The color information can be classified into a plurality of categories. Classification criteria of "vivid," "gradation" and "soft" are prepared as the categories (see FIG. 7 regarding each category). Thresholds represented by the HSV values are set for the respective categories. The color information is classified by the threshold for every category.

More specifically, the category of "vivid" is defined on the basis of a threshold in relation to color saturation S, and colors belonging to the category of "vivid" have respective color saturations S higher than the threshold in each piece of color information. Each color belonging to the category of "vivid" is vivid and has a clear color tone and relatively higher color saturation. The category of "gradation" is defined by a threshold of a predetermined hue level with a hue level of one of colors in each piece of color information serving as a center value. Accordingly, each color belonging to the category of "gradation" presents a color gradation that each color is within a range of "red" to "blue" corresponding to the threshold relative to one color such as "purple." The category of "soft" is defined by lower and upper limits of a threshold of color saturation S and is within the threshold of color saturation S in each piece of color information. The colors classified into the category of "soft" each rarely differ in the color saturation S and give a soft impression. Data of the aforementioned thresholds of "vivid," "gradation" and "soft" is stored on the EEPROM 27, for example.

Figure 6:
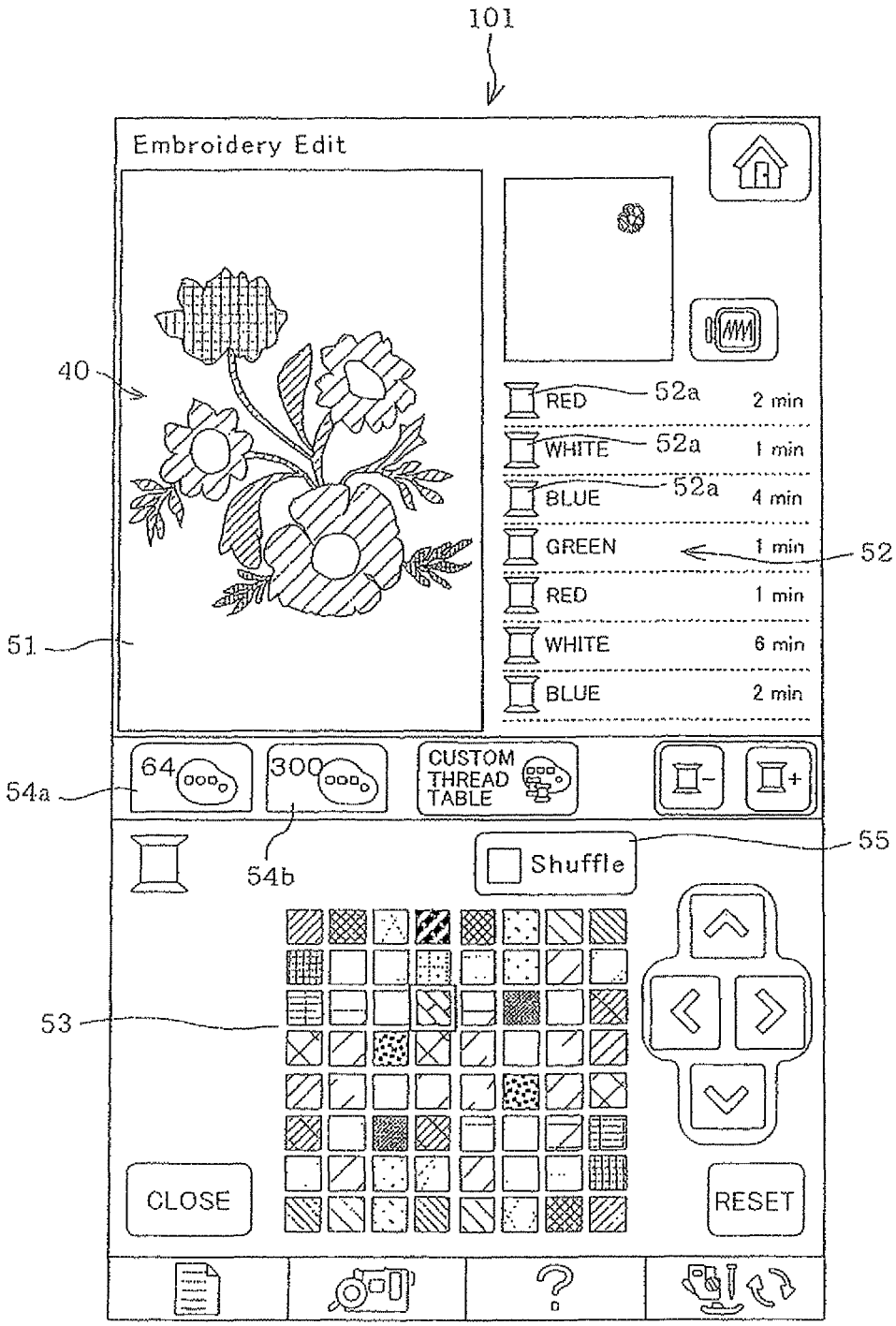
FIG. 6 exemplifies a first color change screen in the generation of embroidery data.

The control device 6 serves as a random number generator that generates a random number using a function with an argument that is the maximum pallet-based color number. More specifically, the control device 6 generates a random number within a range of pallet-based color number in the pallet table (in the range of 1 to 64, for example). The control device 6 checks one of the pallet-based color numbers 1 to 64 in the first pallet table, which one color number corresponds to the generated random number, extracting RSB values or the like corresponding to the pallet-based color number. As a result, one of the colors is randomly extracted from the first color pallet 53 as shown in FIG. 6. Furthermore, when each aforementioned category has been selected, a random number is generated in the range of the number of colors belonging to the selected category, so that one of the colors is randomly extracted from those belonging to the category with the use of the random number.

The generation of embroidery data, or particularly, a screen displayed on the display 7*a* in coloration of thread color data will be described with further reference to FIGS. 6 to 9. Display screens 101 to 104 on the display 7*a* will be described with reference to FIGS. 6 to 9. Since the display 7*a* is a liquid-crystal color display, images of embroidery patterns on the display screens 100 to 104, the 64-color and 300-color pallets 53 and 56*a* and the like are capable of multi-color display.

FIG. 6 exemplifies a first color change screen 101 displayed in the coloration of thread color data. The first color change screen 101 includes a preview image area 51, a thread color data designation area 52, the first color pallet 53, a plurality of pallet selection keys 54*a* and 54*b* and a shuffle key 55. A preview image displayed in the preview image area 51 indicates a result of embroidering when embroidery is carried out on the basis of embroidery data corresponding to an embroidery pattern selected by the user.

Various settings relating to thread colors are executable on the first color change screen 101. More specifically, the thread color data designating area 52 shows colors corresponding to the respective color-based pattern portions in the preview image area 51 together with an illustration of the thread spools 52*a*. When depressing or touching the touch key corresponding to the thread spool 52*a*, the user can designate a color he/she desires out of the first color pallet 53 for every pattern part. For example, RGB values of color numbers 1 to 8 of the 64-color pallet table according to the pallet are assigned to a top row of the 64-color pallet 53 sequentially from the left. Thus, the 64-color pallet 53 includes eight rows each of which further includes eight thread spool color data of the 64-color pallet table.

Figure 7:
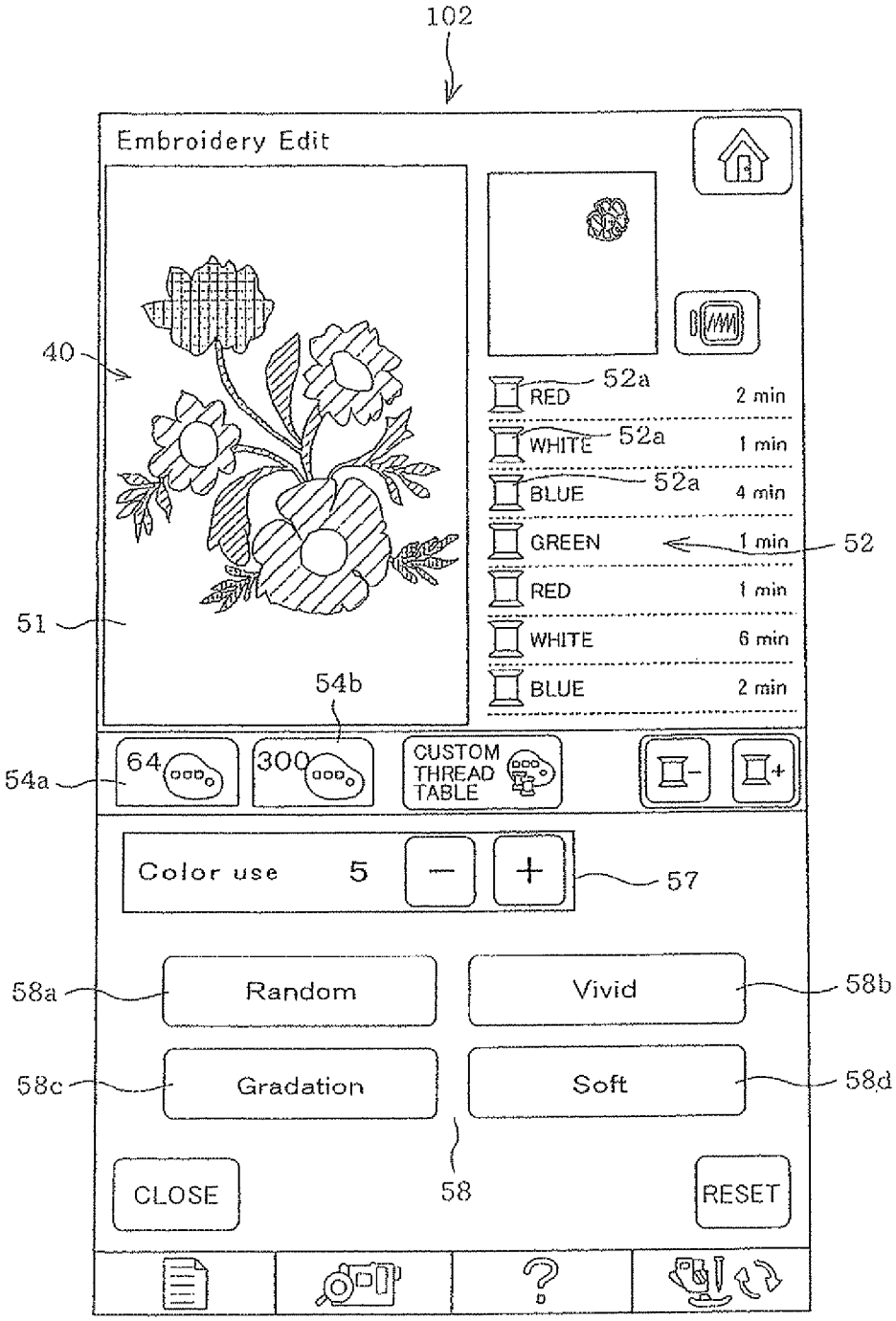
FIG. 7 exemplifies a color tone setting screen.

A second color change screen having a second color pallet is prepared apart from the first color change screen 101 although not shown. The second color pallet of the second color change screen is capable of arranging 300 colors on a 300-square pallet at most on the basis of the RGB values and corresponds to the custom pallet table. When the paired pallet selection keys 54*a* and 54*b* are touched, the display 7*a* is changed between the first color change screen 101 and the second color change screen. When the shuffle key 55 is touched, the first or second color change screen 101A or 101B is switched to a color tone setting screen 102 as shown in FIG. 7.

Figure 8:
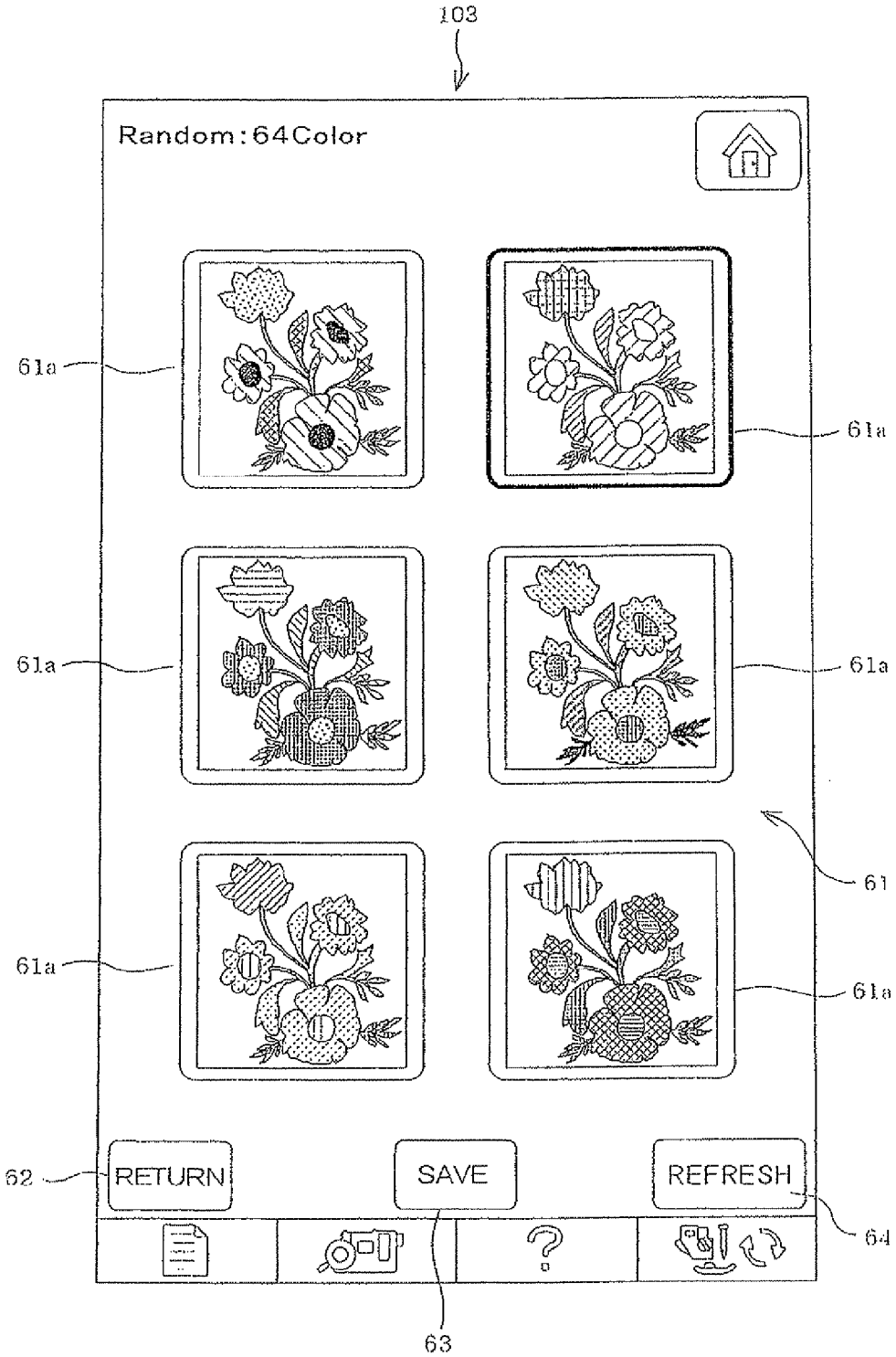
FIG. 8 exemplifies a thumbnail display screen.

The color tone setting screen 102 includes a preview image area 50 and the like as the first color change screen 101. The mode setting screen 102 further includes a category setting section 58 and a random key 58*a*, instead of the first color pallet 53. The category setting section 58 includes a "vivid" key 58*b*, a "gradation" key 58*c* and a "soft" key 58*d*. The random key 58*a* is used to randomly extract a color from one of the plural pallet tables for every thread color data for the purpose of coloration. Furthermore, when any one of the "vivid," "gradation" and "soft" keys 58*b* to 58*d* is touched to be selected, a color to be used as thread color data is randomly extracted from the colors belonging to the selected category. The color tone setting screen 102 is subsequently switched to a thumbnail display screen 103 as shown in FIG. 8.

The thumbnail display screen 103 includes an embroidery pattern selecting area 61 where a plurality of (6, for example) embroidery patterns is displayed, a return key 62, a save key 63 and a refresh key 64. The embroidery pattern selecting area 61 displays a thumbnail image 61*a* obtained by scaling down each one of images of a plurality of embroidery patterns generated using a color randomly extracted as the thread color data and having different coloration combinations. When the save key 63 and the thumbnail image 61*a* are touched in this sequence, embroidery data of the displayed embroidery pattern is stored on the EEPROM 27 as will be described later. Furthermore, when the refresh key 64 is touched, data of a new extracted color is assigned to the thread color data, whereby new six embroidery patterns are displayed instead of those currently displayed. When the return key 62 is touched, the display 7*a* is returned to the color tone setting screen 102. When the thumbnail image of the embroidery pattern is touched, the display 7*a* is changed to an enlarged display screen 104 as shown in FIG. 9.

The enlarged display screen 104 includes an enlarged image area 65, a close key 66 and a set key 67. The enlarged image area 65 displays an image of embroidery pattern obtained by enlarging the thumbnail image (an image 61*a* encompassed by a bold frame as shown in FIG. 8) selected in FIG. 8. When the close key 66 is touched, the display 7*a* is returned to the thumbnail display screen 103. When the set key 67 is touched, the display 7*a* is returned to a menu screen (not shown) displaying an embroidery pattern of the enlarged image area 65 as an embroidery pattern of the preview image.

In view of coloration balance in the entire embroidery pattern, the same color is applied to constituents belonging to the same type as in the case of color-based pattern portions 401, 405, 410 and the like composing the flower petals in FIG. 9. Furthermore, when the number of types of colors used in the coloration of the embroidery pattern exceeds the number of thread spools 15 placed on the spool holder bases 14 (10 in the example), replacement of the thread spools 15 is necessitated during sewing. Accordingly, there is sometimes a case where the number of types of colors to be used in the sewing of an embroidery pattern is set to a smaller value in view of a sewing time, working efficiency in a sewing machine.

In view of the aforementioned case, when original embroidery data includes thread color data in which a plurality of color-based pattern portions includes two or more color-based pattern portions having the same color, the control device 6 is configured to execute an assignment process of assigning a randomly extracted color to the two or more color-based pattern portions so that the two or more color-based pattern portions have the same color. As a result, in the assignment process, a balanced appearance of the embroidery pattern can be maintained after the coloration while the user need not designate colors for every color-based pattern portion. Furthermore, since the number of types of colors used for coloration does not increase in excess of the number of types of colors in the original embroidery data in the assignment process, the generated embroidery data can be prevented from increasing workload such as replacement of thread spools 15 in the sewing.

Figure 12:
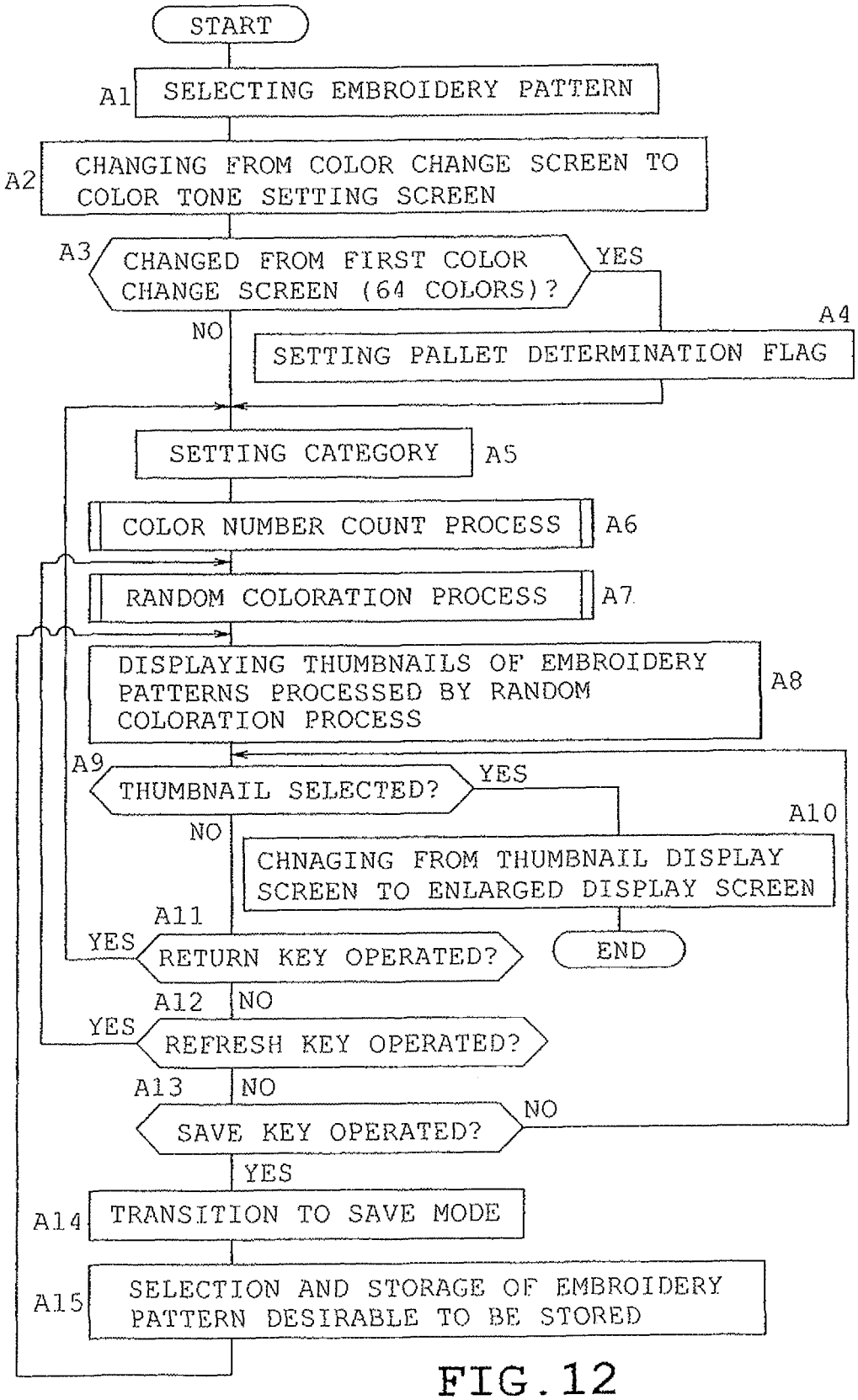
FIG. 12 is a flowchart showing setting of thread color data in an embroidery data generating process.
Figure 13:
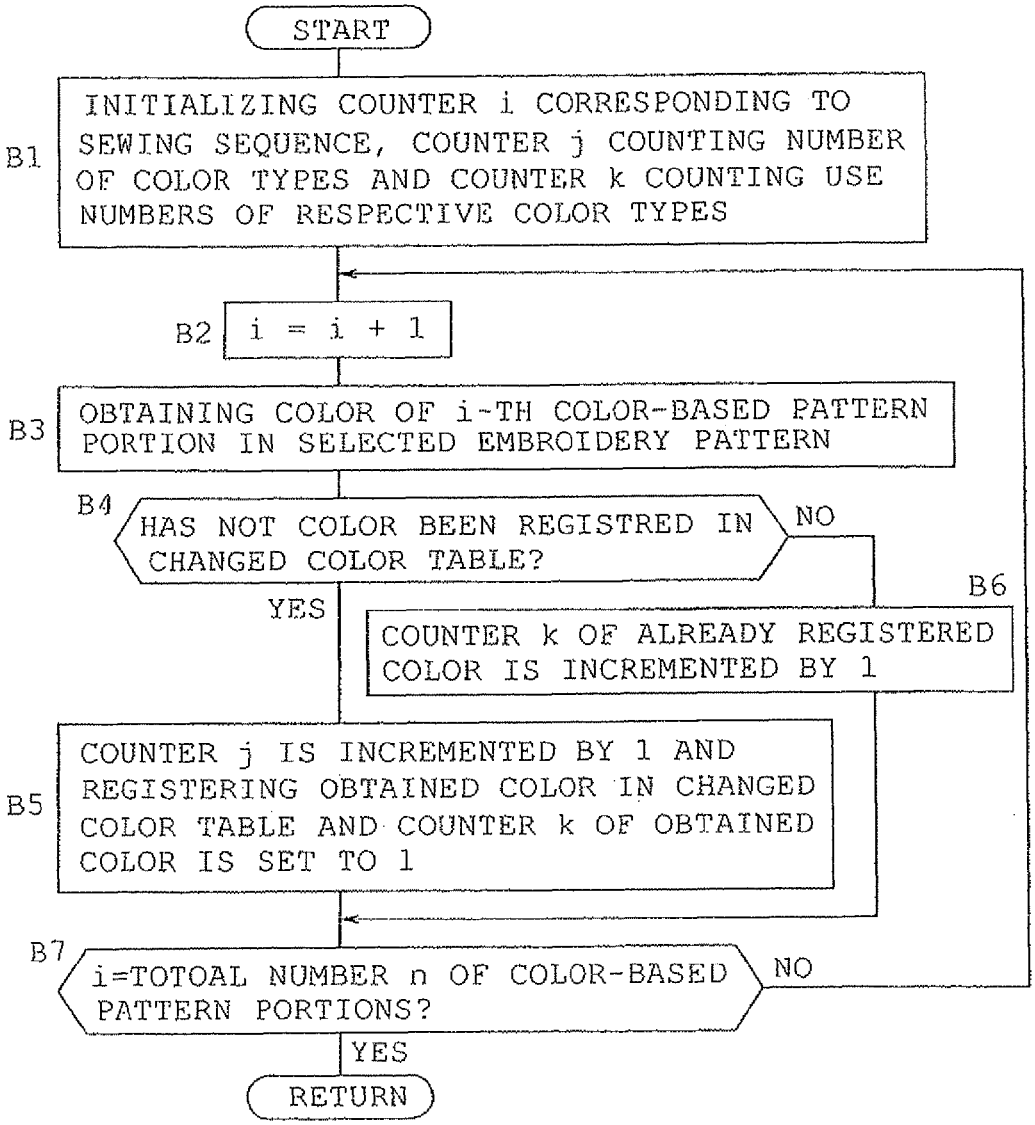
FIG. 13 is a flowchart showing a process of counting colors of the color-based pattern portions.
Figure 14:
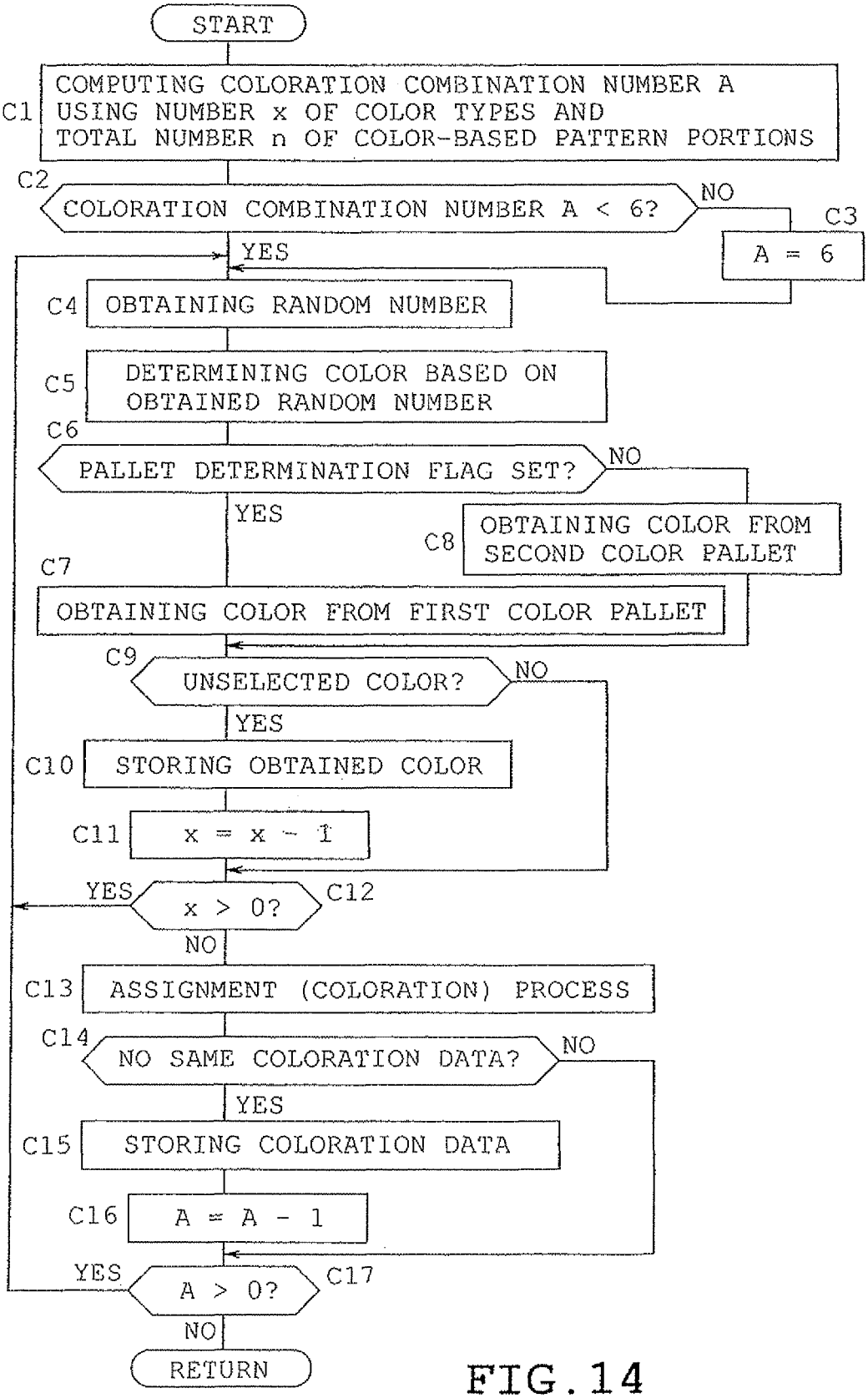
FIG. 14 is a flowchart showing a process of color extraction and color assignment.

The operation of the sewing machine M on the embroidery data processing program will now be described with reference to FIGS. 12 to 14 while a special attention is paid to the coloration of thread color data. FIGS. 12 to 14 are flowcharts showing the processing procedures the control device 6 executes based on the embroidery data processing program.

The user firstly touches the touch panel 7*b* to read the embroidery data from the ROM 25, so that a pattern selection screen (not shown) is displayed on the display 7*a* according to the embroidery data. The user then touches a desirable one of the plural embroidery patterns on the pattern selecting screen to select the same (step A1). As a result, the display 7*a* is switched to the menu screen for generation of embroidery data of the selected embroidery pattern, and the embroidery data is expanded to the RAM 26. For example, when the embroidery pattern 40 is selected, the colors set as the thread color data of the color-based pattern portions 401 to 412 are stored from the head of the thread color data storage area 267 in the sewing sequence of red, white, blue, green, . . . and blue.

The control device 6 then switches the display 7*a* from the menu screen to the first color change screen 101 as shown in FIG. 6 to execute the initial setting process for coloration of the embroidery pattern. More specifically, when the pallet selection key 54*b* is touched on the first color change screen 101, the display 7*a* is switched from the first color change screen 101 to the second color change screen. As a result, the pallet used for random coloration can be changed from the first color pallet 53 to the second color pallet. Furthermore, when the shuffle key 55 is touched, the display 7*a* is switched from the first or second color change screen to the color tone setting screen 102 (step A2). When determining at step A3 that the display 7*a* has been switched from the first or second color change screen to the color tone setting screen 102 (YES), the control device 6 sets the pallet determination flag (step A4).

Any one of the "random," "vivid," "gradation" and "soft" keys 58*a* to 58*d* is touched at step A5, whereby random coloration or category is set. In this case, when the "random" key 58*a* is touched thereby to be selected, 64 colors of the first pallet table or 300 colors of the second pallet table are expanded to the pallet table storage area 266 of the RAM 26.

On the other hand, when anyone of the "vivid," "gradation" and "soft" keys 58*b* to 58*d* is touched thereby to be selected, a color belonging to the selected category is selected from the colors of the first or second pallet table on the basis of the category-based threshold. More specifically, assume now that the control device 6 has determined that the first color pallet 53 has been selected, based on the set state of the pallet determination flag and has further determined that the category of "soft" has been selected. In this case, the control device 6 computes saturations S of the 64 colors of the first pallet table based on respective RCB values, determining whether or not the obtained saturation S of each color is within the threshold of "soft." When determining that the saturation S is within the threshold of "soft," the control device 6 selects the color as belonging to the category of "soft" and stores the color in the pallet table storage area 266. When the category of "vivid" or "gradation" is selected, the first pallet table is updated to the color belonging to the selected category on the basis of the category-based threshold to be stored in the pallet table storage area 266 with the updated contents, in the same manner as described above. When the second color pallet has been set as the pallet to be used for coloration, the same processing as for the first color pallet 53 is carried out.

In the following description, reference symbol "p" designates a total number of colors in the first or second pallet table after process of category-based selection or after execution of step A5. At step A6, the control device 6 executes a color number count process of counting the numbers of respective colors of the color-based pattern portions 401 to 412 stored in the thread color, data storage area 267 regarding the selected embroidery pattern 40 (see FIG. 13). In the color number count process, the control device 6 firstly proceeds to step B1 to reset to zero the counter i corresponding to the sewing sequence of the color-based pattern portions 401 to 412, the counter j counting the number of types of colors and the counter k counting the number of use of colors for every type of color thereby to initialize the counters. Subsequently, the control device 6 increments the counter i by 1 (step B2) to obtain from the thread color data storage area 267 a color (the top "red" in FIG. 10A) of the first pattern portion 401 that is the first in the sewing sequence i, storing the color of "red" in the changed color table storage area 269 (step B3). Since the "red" is a color initially recorded in the changed color table storage area 269 (YES at step B4), the control device 6 increments each of the counters j and k by 1 (step 55). As a result, the thread color data of the top "red" in FIG. 11 is newly recorded and the number of use of the color of the changed color table (the value of the counter k) is set at 1.

Regarding second or subsequent colors (NO at step 57), the counter i is incremented in the same manner as the first color, so that the color of the second pattern portion 402 is obtained from the thread color data storage area 267 (step B2 and 83). Since the color of "white" has not been recorded on the changed color table (YES at step B4), the counter j is incremented by 1 such that the number of color type becomes 2. Furthermore, the counter k corresponding to the number of use of "white" is set to 1. Thus, colors are sequentially obtained from the thread color data storage area 267 according to the sewing sequence i thereby to be registered in the changed color table (steps B2 to B7). The fifth to eighth and tenth to twelfth colors in the sewing sequence i overlap the first to fourth colors in the sewing sequence i. For example, the fifth color of the fifth pattern portion 405 overlaps the "red" of the first pattern portion 401 already registered. Accordingly, the control device 6 determines in the negative at step B4 (NO). In this case, the counter j of the number of types of colors is not incremented, and the counter k corresponding to the number of use of "red" is incremented by 1 to 2 (step B6).

Thus, steps B2 to B7 are repeatedly executed until the control device 6 determines that the counter i corresponds with twelve colors in the thread color data storage area 267, that is, the total number n of color-based pattern portions 401 to 412 (YES at step B7). Consequently, the control device 6 registers the thread color data of red, white, blue, green and yellow previously set in the selected embroidery data and the numbers k of use of the respective colors in the changed color table, as shown in FIG. 11. Furthermore, the number x (=5) of types of the aforementioned colors of red to yellow is obtained on the basis of the value of the counter j, and the control device 6 then returns to step A7.

A random coloration process is executed at step A7 on the basis of the above-described various settings and the results of counting operations in the color number count process (see FIG. 14). In the random coloration process, the control device 6 proceeds to step C1 to compute the coloration combination number A of the embroidery pattern, based on the color type number x of each color-based pattern portion and the total number n of color-based pattern portions.

In the embodiment, for example, in order that six embroidery patterns having different colorations may be displayed on a thumbnail screen 103, the combination number A necessary for purpose of display is computed by the use of combination so that combinations without overlap are obtained. Accordingly, the coloration combination number A is represented as ${}_pC_1$, for example, when the color type number x is 1 and the total number of color-based pattern portions is 1. The coloration combination number A of the embroidery pattern thus bears a proportional relation with the total number p of colors in the first or second pallet table. The coloration combination number A becomes not less than 6 when the total number p is not less than 2 and the color type number x is not less than 3. In this case, the control device 6 determines in the negative (NO) at step C2 and sets the sewing machine 4 so that six embroidery data are generated (step C3). Furthermore, when the coloration combination number A computed at step C1 is less than 6 (YES at step C2), that number of embroidery data is generated.

The control device 6 then generates a random number within total number p of colors of the first or second pallet table in the pallet table storage area 266 (step C4). For example, when the first color pallet 53 has been set as a pallet to be used for coloration and no category has been set, a random number is generated within the range from 1 to 64. The control device 6 then extracts a color in a random manner based on the obtained random number and the set state of a pallet determination flag (steps C5 to C8). In more detail, when determining that the first color pallet 53 has been selected, on the basis of set state of the pallet determination flag (YES at step C6), the control device 6 checks whether the generated random number corresponds with the pallet-based color numbers 1 to 64 of the first pallet table. The control device 6 then extracts a color (KGB value) corresponding to the relevant pallet-based color number (step C7). The extracted first color is stored in the changed color table storage area 269 without any change (YES at step C9; and step C10). In this case, the first color (purple, for example) extracted at step C7 is stored with correlation with the use number k of the "red" at the top of the changed color table in FIG. 11.

The color type number x is updated to every time the extracted color is stored in the changed color table storage area 269 (step C11). Furthermore, steps C4 to C9 are also executed regarding extraction of second and subsequent colors (YES at step C12). When an extracted color does not overlap the already extracted one (YES at step C9), the storing of the extracted color and decrement of the color type number x are carried out in the same manner as the first color. The control device 6 repeatedly executes steps C4 to C12 until determining that the color type number x is not more than 0 as the result of subtraction (NO at step C12). Consequently, different colors is extracted the number of which is equal to the color type number x in the embroidery pattern selected at step A1. FIG. 11 shows a changed color table in the case where "purple," "black," "orange," "brown" and "pink" are sequentially extracted regarding the embroidery pattern 40. The changed color table stores the colors of "purple" to "pink" with correlation with the use numbers k of the respective original colors before extraction as shown in FIG. 11.

Subsequently, the control device 6 proceeds to an assignment process to assign the extracted colors to the respective color-based pattern portions on the basis of the changed color table generated as described above (step C13). More specifically, the original colors of the color-based pattern portions 401 to 412 are stored in the sewing sequence in the thread color data storage area 267 (see FIG. 10A). The control device 6 checks the changed color table against the colors of the color-based pattern portions 401 to 412 in the thread color data storage area 267, executing the assigning process using only the use numbers k corresponding to the colors extracted at steps C4 to C12 so that the original colors of the color-based pattern portions 401 to 412 are updated.

More specifically, thread color data to be updated with the use of "purple" is assigned to each of the thread color data of the first pattern portion 401, the fifth pattern portion 405 and the tenth pattern portion 410 of the color of "red" in the thread color data storage area 267 in FIG. 10A (see FIG. 10B). In this case, the color of "purple" has the same use number k as each of the thread color data of the first pattern portion 401, the fifth pattern portion 405 and the tenth pattern portion 410 of the color of "red." In the same manner, thread color data to be updated with the use of "black" is assigned to each of the thread color data of the second pattern portion 402, the sixth pattern portion 406 and the eleventh pattern portion 411 of the color of "white." In this case, the color of "black" has the same use number k as each of the thread color data of the second pattern portion 402, the sixth pattern portion 406 and the eleventh pattern portion 411 of the color of "white." Furthermore, thread color data to be updated with the use of "orange" is assigned to each of the thread color data of the second pattern portion 402, the sixth pattern portion 406 and the eleventh pattern portion 411 of the color of "blue." In this case, the color of "orange" has the same use number k as each of the thread color data of the second pattern portion 402, the sixth pattern portion 406 and the eleventh pattern portion 411 of the color of "blue." Thread color data to be updated with the use of "brown" is assigned to each of the thread color-data of the fourth pattern portion 404 and the eighth pattern portion 408 of the color of "green." In this case, the color of "brown" has the same use number k as each of the thread color data of the fourth pattern portion 404 and the eighth pattern portion 408 of the color of "green." Thread color data to be updated with the use of "pink" is assigned to the thread color data of the ninth pattern portion 409 of the color of "yellow." In this case, the color of "pink" has the same use number k as the thread color data of the ninth pattern portion 409 of the color of "yellow."

The extracted colors are thus assigned to the n-number of color-based pattern portions by the respective use numbers k. When the coloration of the first embroidery pattern is completed, all the thread color data is stored in the changed data storage area 268 of the RAM 26 (YES at step C14; and step C15). In this case, the colors having been assigned to the respective color-based pattern portions 401 to 412 are stored in the changed data storage area 268 from the head in the sewing sequence of "purple," "black," "orange," "brown," . . . and "orange," as shown in FIG. 103. Consequently, as understood from comparison of FIGS. 10A and 10B, when two or more of the color-based pattern portions 401 to 412 in the selected embroidery pattern 40 have the same color, the randomly extracted color is assigned to the two or more color-based pattern portions having the same color so that these color-based pattern portions have the randomly selected same color (see FIG. 9).

Subsequently, the coloration combination number A is updated to A=A−1 (step C16) and the control device 6 returns to step C4 (YES at step C17). Furthermore, steps C4 to C14 are also executed for the purpose of coloration of second and subsequent embroidery patterns. When the obtained coloration differs from the already generated coloration of embroidery patterns (YES at step C14), the storing of thread color data and decrement of the coloration combination number A are carried out in the same manner as in the above-described first embroidery pattern (steps C15 and C16). Thus, the control device 6 repeatedly executes the steps C4 to C17 until determining that the coloration combination number A is not more than 0 (NO at step C17), whereby A-number of combinations of embroidery patterns differing in coloration are generated. The control device 6 subsequently returns to step A8 in FIG. 12.

Images reduced in size or thumbnail images of the A-number (6 in FIG. 8) of embroidery patterns differing in coloration are displayed on the thumbnail display screen 103 at step A8. For example, when a thumbnail image 61*a* of embroidery pattern located in the right top in FIG. 8 is touched (YES at step A9), the display 7*a* is changed to an enlarged display screen 104 in FIG. 9 (step A10). An enlarged embroidery pattern of the selected thumbnail image is displayed on the enlarged display screen 104. When a set key 67 is touched on the enlarged display screen 104, the display 7*a* is returned to the menu screen on which the embroidery pattern in the enlarged image area 65 is displayed as the preview image of the embroidery pattern (end).

When the return key 62 is touched on the thumbnail display screen 103 (YES at step A11), the control device 6 proceeds to step A5 to display the setting screen 102, so that various setting processes can be re-carried out for re-execution of the random coloration process. Furthermore, when the refresh key 64 is touched (YES at step A12), the control device 6 proceeds to step A7 to re-execute the random coloration process. As a result, newly extracted colors are assigned to the thread color data, and six new embroidery patterns are displayed instead of the currently displayed six embroidery patterns.

On the other hand, when the save key 63 is touched on the thumbnail display screen 103 (YES at step A13), the control device 6 proceeds to the same mode (step A14). When one or a plurality of thumbnail images 61*a* is touched to be selected under the save mode, embroidery data of the embroidery pattern is stored on the EEPROM 27 (step A15).

As described above, the control device 6 serves as an assignment unit to execute an assignment routine of randomly extracting the colors to be used as thread color data and assigning the extracted colors at steps C4 to C17. The control device 6, the display 7*a* and the touch panel 7*b* all of which get involved in execution of step A1 serve as embroidery data selecting unit which selects desirable embroidery data. Furthermore, the control device 6 executes, as a color number count unit, a color number count routine of counting the number of colors for every color type in the embroidery data selected by the embroidery data selecting unit.

In the sewing machine M, sewing can be executed for every one of color-based pattern portions 401 to 412 on the basis of desirable embroidery data to which the new coloration has been applied as described above. In the sewing, the user changes the display 7*a* from the menu screen to the thread spool setting screen to substitute the thread spools 15 necessary for the sewing of the embroidery pattern 40. In this case, as described above, the thread spool color data of the thread spools 15 set on the spool holder bases 14 is automatically input on the basis of the thread color data of the embroidery pattern 40 by the control device 6 (see FIG. 5). Accordingly, the thread spool color data need not be input by the user separately, whereby the sewing can be executed on the basis of the desirable embroidery data.

The above-described embroidery data generating device 39 can execute the random coloration by extracting colors and assigning the extracted colors to the thread color data of color-based pattern portions. Consequently, the coloration of the embroidery pattern can easily be carried out with elimination of a troublesome work such as confirmation and designation of thread color data. Furthermore, the coloration that evokes accidentalness or surprise can be applied to an embroidery pattern, and a variety of coloration patterns defying the boundaries of previously defined coloration can be obtained.

When original embroidery data includes thread color data in which a plurality of color-based pattern portions includes two or more color-based pattern portions having the same color, the control device 6 is configured to execute an assignment process of assigning a randomly extracted color to the two or more color-based pattern portions so that the two or more color-based pattern portions have the same color. Accordingly, even when an embroidery pattern is randomly colored, a balanced appearance of the embroidery pattern can be maintained even after the coloration while the user need not designate colors for every color-based pattern portion. Furthermore, the number of types of colors used for coloration can be caused to correspond with the number of types of colors in the original embroidery data. Accordingly, the number of types of colors in the embroidery data after coloration can be prevented from being excessively increased with execution of the random coloration, with the result that suitable embroidery data can practically be generated.

The control device 6 serves as the color number count unit which counts the number of colors. Based on the color number obtained by the counting, the control device 6 extracts different colors by the same number as the number of color types in the embroidery data and assigns the obtained color to the color-based pattern portions having the same color so that the color-based pattern portions have the same color by the extracted color. As a result, the colors necessary for the coloration of an embroidery pattern can be extracted in just proportion.

The display unit is configured to execute a display routine (steps A8 and A10) of displaying on the display screens 103 and 104 an embroidery pattern colored by colors assigned to thread data of the respective color-based pattern portions. As a result, the colors of the color-based pattern portions in the generated embroidery data can easily be grasped visually.

A plurality of candidate embroidery patterns having different combinations of colors randomly colored is displayed on the thumbnail display screen 103 of the display 7*a*. A desirable one of the candidate embroidery patterns can be selected to be stored on the EEPROM 27. This can improve the usability of the embroidery pattern data generating device 39 and obtain embroidery data with the coloration according to the user's preference or user's feeling.

The foregoing embodiment should not be restrictive but may be modified or expanded as follows. The embroidery data generating device should not be limited to being built in the sewing machine M. The embroidery data generating device may be constituted by a device body or a personal computer (which may or may not be dedicated), a mouse, a keyboard, a memory card connector, a display and the like all of which are connected to the device body. Furthermore, the embroidery data generating device may be applied to household sewing machines. This case can achieve the same advantageous effect as that of the foregoing embodiment.

The color data storage unit should not be limited to the EEPROM 27 and the RAM 26. The embroidery data storage unit should not be limited to the ROM 25. These storage units may be other inner storage units incorporated in the sewing machine M or external storage units detachably attachable to the sewing machine M.

A storage medium storing the embroidery data processing program should not be limited to the ROM 25 of the control device 6. The storage medium may be a USB memory, a CD-ROM, a flexible disc, a DVD, a memory card or the like. In this case, the embroidery data processing program may be read by a computer of the control device of the embroidery data generating device to be executed. As a result, this modification can achieve the same operation and advantageous effect each as that achieved by the foregoing embodiment.

The foregoing description and drawings are merely illustrative of the present disclosure and are not to be construed in a limiting sense. Various changes and modifications will become apparent to those of ordinary skill in the art. All such changes and modifications are seen to fall within the scope of the appended claims.

What is claimed is:

1. An embroidery data generating device which generates embroidery data usable to sew, by a sewing machine, an embroidery pattern composed of a plurality of color-based pattern portions, the device comprising:

an embroidery data storage unit which is configured to store a plurality of embroidery data;

an embroidery data selection unit which is configured to select a desired one of the embroidery data stored on the embroidery data storage unit;

a color data storage unit which is configured to store data of a plurality of defined colors; and an assignment unit which is configured to randomly extract colors from the colors stored on the color data storage unit, the extracted colors being used as thread color data for specifying colors of the color-based pattern portions respectively, the assignment unit assigning the extracted colors to the respective color-based pattern portions composing the selected embroidery pattern, wherein when the embroidery data selected by the embroidery data selection unit includes thread color data of two or more color-based pattern portions having a same color, a randomly extracted color is assigned to said two or more color-based pattern portions so that said two or more color-based pattern portions have the same color and the thread color is updated.

2. The device according to claim 1, further comprising a color count unit which is configured to count colors for every type of color in embroidery data selected by the embroidery data selection unit, wherein the assignment unit extracts different colors having a same number as a number of types of colors included in the embroidery data and assigns the extracted colors to the two or more color-based pattern portions so that the two or more color-based pattern portions have the same color, based on the number of colors counted by the color count unit.

3. The device according to claim 2, further comprising a display unit which is configured to display the embroidery pattern in the colors assigned to the thread color data of the color-based pattern portions thereof.

4. The device according to claim 1, further comprising a display unit which is configured to display the embroidery pattern in the colors assigned to the thread color data of the color-based pattern portions thereof.

5. A non-transitory computer readable storage medium which is incorporated in an embroidery data generating device including an embroidery data storage unit which is configured to store a plurality of embroidery data for sewing by a sewing machine an embroidery pattern composed of a plurality of color-based pattern portions, an embroidery data selection unit which is configured to select a desired one of the embroidery data stored on the embroidery data storage unit and a color data storage unit which is configured to store data of a plurality of defined colors, the non-transitory computer readable storage medium storing an embroidery data processing program used to generate new embroidery data by using the embroidery data stored in the embroidery data storage unit, the embroidery data processing program comprising:

an assignment routine of randomly extracting colors from the colors stored on the color data storage unit and assigning the extracted colors to the respective color-based pattern portions composing the selected embroidery pattern, the extracted colors being used as thread color data for specifying colors of the color-based pattern portions respectively, wherein when, in the assignment routine, the embroidery data selected by the embroidery data selection unit includes thread color data of two or more color-based pattern portions having a same color, a randomly extracted color is assigned to said two or more color-based pattern portions so that said two or more color-based pattern portions have the same color and the thread color is updated.

6. The medium according to claim 5, wherein the embroidery data processing program further comprises a color count routine of counting colors for every type of color in embroidery data selected in the embroidery data selection routine, wherein the assignment routine extracts different colors having a same number as a number of types of colors included in the embroidery data and assigns the extracted colors to the two or more color-based pattern portions so that the two or more color-based pattern portions have the same color, based on the number of colors counted in the color count routine.

7. The medium according to claim 6, wherein the embroidery data generating device further includes a display unit which displays the embroidery pattern in the colors assigned to the thread color data of the color-based pattern portions thereof, and the embroidery data processing program further comprises a display routine of displaying the embroidery pattern in the colors assigned to the thread color data of the color-based pattern portions thereof.

8. The medium according to claim 5, wherein the embroidery data generating device further includes a display unit which displays the embroidery pattern in the colors assigned to the thread color data of the color-based pattern portions thereof, and the embroidery data processing program further comprises a display routine of displaying the embroidery pattern in the colors assigned to the thread color data of the color-based pattern portions thereof.

9. A sewing machine which sews an embroidery pattern composed of a plurality of color-based pattern portions, based on embroidery data, the machine including an embroidery data generating device comprising:

an embroidery data storage unit which is configured to store data of a plurality of embroidery data;

an embroidery data selection unit which is configured to select a desired one of the embroidery data stored on the embroidery data storage unit;

a color data storage unit which is configured to store data of a plurality of defined colors; and an assignment unit which is configured to randomly extract colors from the colors stored on the color data storage unit, the extracted colors being used as thread color data for specifying colors of the color-based pattern portions respectively, the assignment unit assigning the extracted colors to the respective color-based pattern portions composing the selected embroidery pattern, wherein when the embroidery data selected by the embroidery data selection unit includes thread color data of two or more color-based pattern portions having a same color, a randomly extracted color is assigned to said two or more color-based pattern portions so that said two or more color-based pattern portions have the same color and the thread color is updated.

* * * * *